US008526642B2

(12) United States Patent
Chung et al.

(10) Patent No.: US 8,526,642 B2
(45) Date of Patent: Sep. 3, 2013

(54) PIEZOELECTRIC MICRO SPEAKER INCLUDING WEIGHT ATTACHED TO VIBRATING MEMBRANE AND METHOD OF MANUFACTURING THE SAME

(75) Inventors: Seok-whan Chung, Suwon-si (KR); Dong-kyun Kim, Suwon-si (KR); Byung-gil Jeong, Anyang-si (KR); Jun-sik Hwang, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 748 days.

(21) Appl. No.: 12/693,481

(22) Filed: Jan. 26, 2010

(65) Prior Publication Data

US 2011/0075867 A1 Mar. 31, 2011

(30) Foreign Application Priority Data

Sep. 25, 2009 (KR) ..... 10-2009-0091148

(51) Int. Cl.
*H04R 25/00* (2006.01)

(52) U.S. Cl.
USPC ..... 381/190; 381/173

(58) Field of Classification Search
USPC ..... 381/190, 186, 191, 173–175; 310/322, 310/317
See application file for complete search history.

(56) References Cited

U.S. PATENT DOCUMENTS

| | | | | |
|---|---|---|---|---|
| 6,795,561 | B1 | 9/2004 | Bank | |
| 8,107,650 | B2 * | 1/2012 | Fujiwara et al. | 381/190 |
| 2010/0074459 | A1 * | 3/2010 | Chung et al. | 381/190 |
| 2010/0156238 | A1 * | 6/2010 | Kim et al. | 310/322 |
| 2011/0051985 | A1 * | 3/2011 | Hwang et al. | 381/396 |
| 2011/0064250 | A1 * | 3/2011 | Jeong et al. | 381/186 |
| 2011/0075867 | A1 * | 3/2011 | Chung et al. | 381/190 |
| 2011/0075879 | A1 * | 3/2011 | Kim et al. | 381/398 |
| 2012/0176002 | A1 * | 7/2012 | Kim et al. | 310/317 |

FOREIGN PATENT DOCUMENTS

| | | | |
|---|---|---|---|
| JP | 58-019099 | A | 2/1983 |
| JP | 6-078397 | A | 3/1994 |
| KR | 10-0448108 | A | 9/2004 |

OTHER PUBLICATIONS

Korent Patent Translation of KR 10-0448108 A. Title: Piezoelectric Sounding Body and Its Production. Published: Sep. 1, 2004. Inventors: Watabe Yoshiyuki, Uenishi Hiroaki, Kaino Daisuke, Shibuya Kazuyuki.*

* cited by examiner

*Primary Examiner* — Mohammad Islam
*Assistant Examiner* — Phylesha Dabney
(74) *Attorney, Agent, or Firm* — Sughrue Mion, PLLC

(57) ABSTRACT

Provided are a piezoelectric micro speaker and a method of manufacturing the same. The piezoelectric micro speaker includes: a substrate having a cavity therein; a diaphragm that is disposed on the substrate, the diaphragm including a vibrating membrane that overlaps the cavity; a piezoelectric actuator that is disposed on the vibrating membrane; and a weight that is disposed in the cavity and attached to a center portion of the vibrating membrane.

12 Claims, 9 Drawing Sheets

PIEZOELECTRIC MICRO SPEAKER INCLUDING WEIGHT ATTACHED TO VIBRATING MEMBRANE AND METHOD OF MANUFACTURING THE SAME

CROSS-REFERENCE TO RELATED APPLICATION

This application claims priority from Korean Patent Application No. 10-2009-0091148, filed on Sep. 25, 2009, in the Korean Intellectual Property Office, the disclosure of which is incorporated herein in its entirety by reference.

BACKGROUND

1. Field

One or more embodiments relate to piezoelectric micro speakers, and more particularly, to piezoelectric micro speakers including a weight attached to a vibrating membrane and methods of manufacturing the same.

2. Description of the Related Art

As terminals for personal voice communication and data communication have developed, amounts of data to be transmitted and received has continuously increased, while the terminals are required to be small and multi-functional.

In order to satisfy this requirement, research has been conducted on an acoustic device using micro electro-mechanical system (MEMS) technology. In particular, MEMS and semiconductor technologies make it possible to manufacture a micro speaker with a small size and low cost according to a package process and to easily integrate the micro speaker with a peripheral circuit.

Micro speakers using MEMS technology are mainly divided into electrostatic micro speakers, electromagnetic micro speakers, and piezoelectric micro speakers. In particular, a piezoelectric micro speaker may be driven at a lower voltage than in an electrostatic micro speaker, may have a simpler and slimmer structure than an electromagnetic micro speaker.

SUMMARY

Provided are piezoelectric micro speakers including weight attached to a vibrating membrane and methods of manufacturing the same.

Additional aspects will be set forth in part in the description which follows and, in part, will be apparent from the description, or may be learned by practice of the presented embodiments.

According to one or more embodiments, a piezoelectric micro speaker includes: a substrate having a cavity therein; a diaphragm that is disposed on the substrate, the diaphragm including a vibrating membrane that overlaps the cavity; a piezoelectric actuator that is disposed on the vibrating membrane; and a weight that is disposed in the cavity and attached to a center portion of the vibrating membrane.

The weight may have a substantially columnar shape, and a center of the weight may be disposed on a center line of the cavity. The weight and the substrate may be formed of the same material, and a length of the weight may be equal to or smaller than a thickness of the substrate. The weight may have a substantially cylindrical shape, and a diameter of the weight may be between about 50 μm and about 1000 μm.

The piezoelectric actuator may include a first electrode layer disposed on the vibrating membrane, a piezoelectric layer disposed on the first electrode layer, and a second electrode layer disposed on the piezoelectric layer. A first lead line that is connected to the first electrode layer and a second lead line that is connected to the second electrode layer may be formed on the diaphragm, a first electrode pad may be connected to an end of the first lead line and a second electrode pad may be connected to an end of the second lead line. The vibrating membrane of the diaphragm may include a first vibrating membrane formed over a center of the cavity, and a second vibrating membrane formed over an edge of the cavity and formed of a different material from the first vibrating membrane, wherein the piezoelectric actuator is formed on the first vibrating membrane, and the weight is attached to the center of the first vibrating membrane.

The second vibrating membrane may be formed of a material having a lower modulus of elasticity than the first vibrating membrane, such as a polymer thin film. The second vibrating membrane may also be disposed on the upper surface of the piezoelectric actuator and on the upper surface of the diaphragm outside the cavity.

According to one or more embodiments, a method of manufacturing a piezoelectric micro speaker includes: forming a diaphragm, including a vibrating membrane, on a first side of a substrate; forming a piezoelectric actuator on the vibrating membrane; and forming a cavity passing through the substrate in a thickness direction by etching a surface of a second side of the substrate, opposite the first side, until the vibrating membrane is exposed, and forming a weight disposed in the cavity and attached to a center portion of the vibrating membrane.

A center of the weight may be disposed on a center line of the cavity. The weight may be formed of the same material as the substrate, and the length of the weight may be equal to or smaller than the thickness of the substrate. The weight may have a substantially cylindrical shape, and the diameter thereof may be between about 50 μm and about 1000 μm. The piezoelectric actuator may include a first electrode layer, a piezoelectric layer, and a second electrode layer that are sequentially formed on the vibrating membrane. The forming of the piezoelectric actuator may include: forming, on the diaphragm, a first lead line that is connected to the first electrode layer and a second lead line that is connected to the second electrode layer, and forming a first electrode pad at an end of the first lead line and forming a second electrode pad at an end of the second lead line.

The forming of the diaphragm may include: forming a first vibrating membrane and forming a trench surrounding the first vibrating membrane, and, after forming the piezoelectric actuator, forming a second vibrating membrane, that is formed of a different material from the first vibrating membrane, in the trench; and the etching may include etching the second side of the substrate such that a center of the cavity is formed under the first vibrating membrane, and an edge of the cavity is formed under the second vibrating membrane.

The second vibrating membrane may be formed of a material having a lower modulus of elasticity than that of a material of the first vibrating membrane, a polymer thin film.

The forming of the second vibrating membrane may further include: forming the second vibrating membrane on the upper surface of the piezoelectric actuator inside and on the upper surface of the diaphragm outside the cavity.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
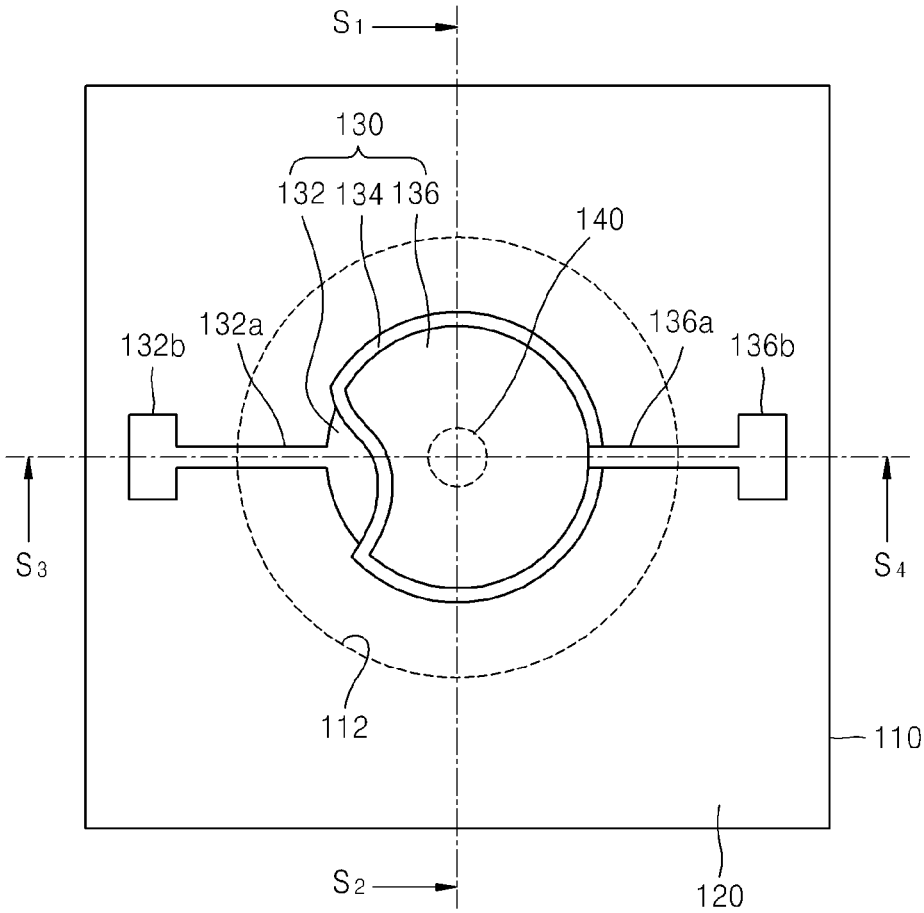
FIG. 1 is a plan view of a piezoelectric micro speaker, according to an embodiment.

Reference will now be made in detail to embodiments which are illustrated in the accompanying drawings, wherein like reference numerals refer to the like elements throughout. In this regard, the present embodiments may have different forms and should not be construed as being limited to the descriptions set forth herein.

Figure 2A:
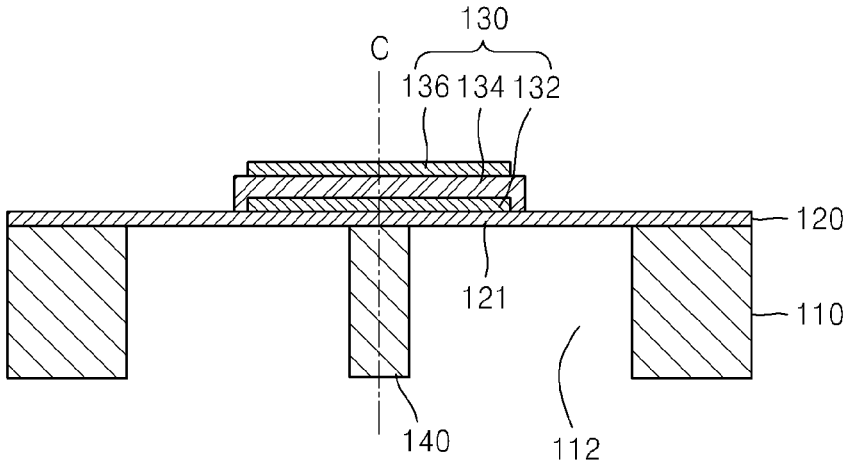
FIGS. 2A and 2B are cross-sectional views of the piezoelectric micro speaker illustrated in FIG. 1 taken along lines S1-S2 and S3-S4 of FIG. 1, respectively.
Figure 2B:
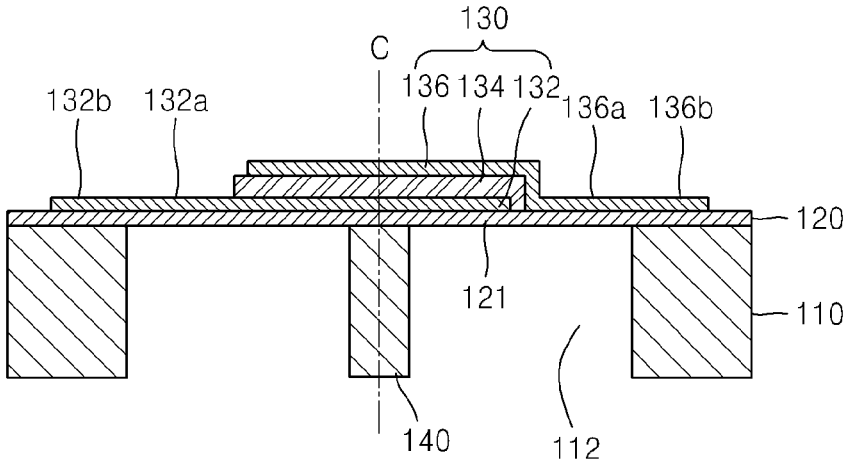

FIG. 1 is a plan view of a piezoelectric micro speaker, according to an embodiment. FIGS. 2A and 2B are cross-sectional views of the piezoelectric micro speaker illustrated in FIG. 1 taken along lines S1-S2 and S3-S4 of FIG. 1, respectively.

Referring to FIGS. 1, 2A, and 2B, the piezoelectric micro speaker includes a substrate 110 having a cavity 112, a diaphragm 120 formed on the substrate 110 to cover the cavity 112, a piezoelectric actuator 130 formed on the diaphragm 120, and a weight 140 disposed in the cavity 112.

More specifically, the substrate 110 may be formed of a silicon wafer that is finely micromachined. The cavity 112 may be formed to penetrate a predetermined portion of the substrate 110 in a thickness direction and, for example, may be in a cylindrical shape.

The diaphragm 120 may be formed having a predetermined thickness on one side of the substrate 110, and include a vibrating membrane 121 formed on a region corresponding to the cavity 112. That is, a part of the diaphragm 120 that covers the cavity 112 functions as the vibrating membrane 121. The diaphragm 120 may be formed of an insulating material such as a silicon nitride, for example, $Si_3N_4$. Accordingly, the vibrating membrane 121 may be formed of the same material as the insulating material.

The piezoelectric actuator 130 vibrates the vibrating membrane 121 and may include a first electrode layer 132, a piezoelectric layer 134, and a second electrode layer 136 that are sequentially formed on the vibrating membrane 121. The first electrode layer 132 and the second electrode layer 136 may be formed of conductive metals. The piezoelectric layer 134 may be formed of a piezoelectric material, for example, aluminum nitride (AlN), zinc oxide (ZnO), or lead zirconate titanate (LZT).

A first lead line 132*a* that is connected to the first electrode layer 132 of the piezoelectric actuator 130 and a second lead line 136*a* that is connected to the second electrode layer 136 of the piezoelectric actuator 130 may be formed on the diaphragm 120. The first lead line 132*a* and the second lead line 136*a* may be opposite to each other in view of a center of the piezoelectric actuator 130. A first electrode pad 132*b* is connected to an end of the first lead line 132*a*. A second electrode pad 136*b* is connected to an end of the second lead line 136*a*.

The weight 140 is disposed in the cavity 112 and is attached to a center portion of the lower surface of the vibrating membrane 121. The weight 140 may have a variety of shapes, for example, a columnar shape. A center of the weight 140 may be disposed on a center line C of the cavity 112. For example, the weight 140 may have a cylindrical shape. The weight 140 may be formed of the same material as the substrate 110, and be longer or shorter than the thickness of the substrate 110. For example, the thickness of the substrate 110 may be about 500 μm. In this case, the length of the weight 10 may be between about 250 μm and about 500 μm.

The weight 140 is attached to the center portion of the vibrating membrane 121 where the vibration displacement is the greatest due to the movement of the piezoelectric actuator 130, which increases the entire mass of the vibrating membrane 121. Thus, a resonance frequency of the vibrating membrane 121 is reduced, thereby improving the sound pressure at a low frequency band. If the diameter of the weight 140 is reduced, for example, if the diameter is between about 50 μm and about 1000 μm, a contact area between the weight 140 and the vibrating membrane 121 is reduced. Thus, the weight 140 has relatively little influence on the movement of the piezoelectric actuator 130, which does not disturb the vibration of the vibrating membrane 121. This will be described in more detail with reference to FIGS. 5A and 5B.

Figure 3:
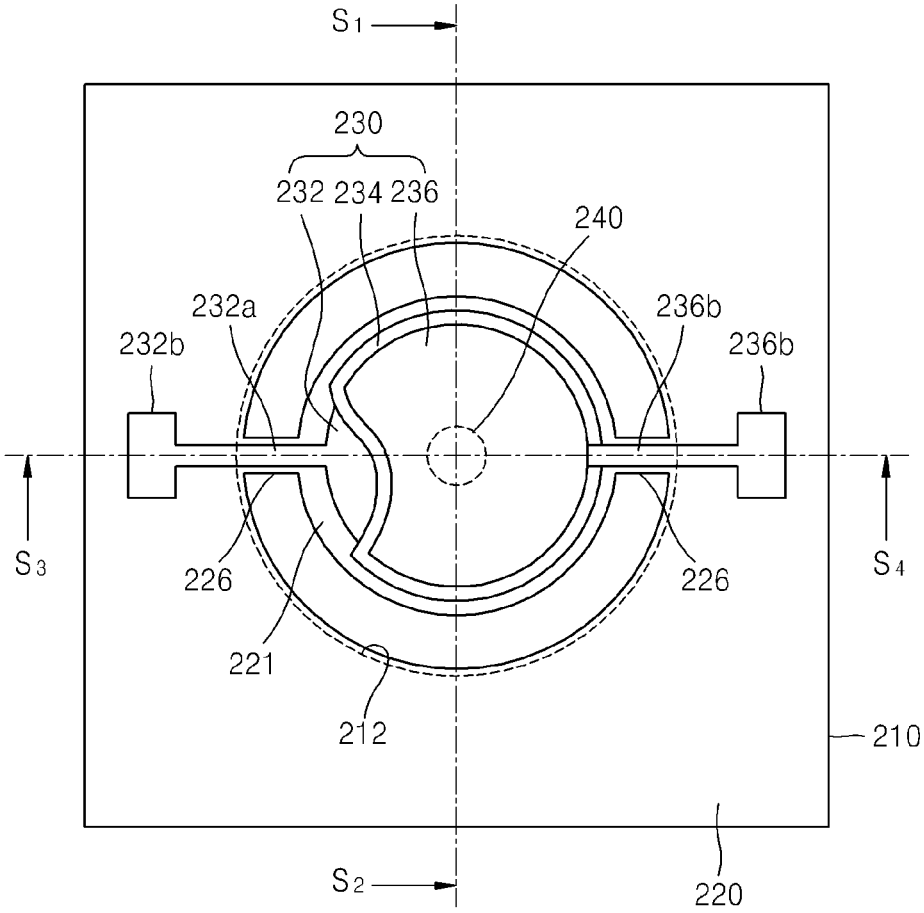
FIG. 3 is a plan view of a piezoelectric micro speaker from which a second vibrating membrane is removed, according to another embodiment.
Figure 4A:
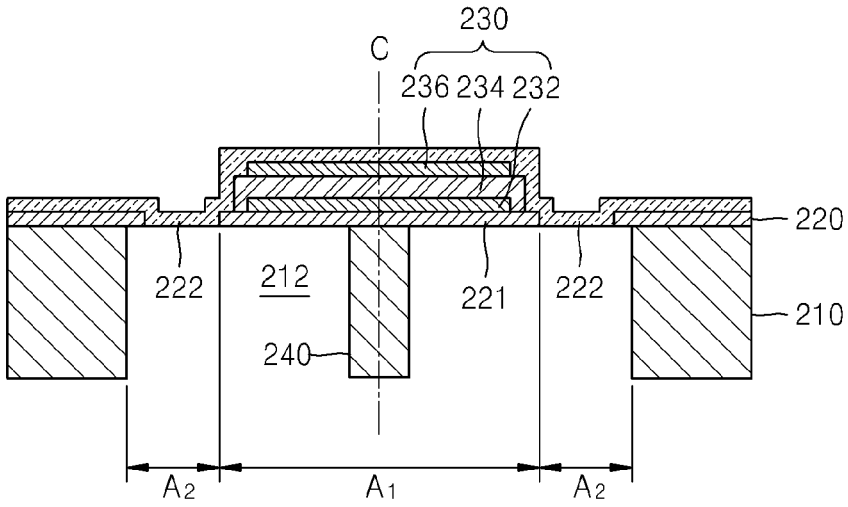
FIGS. 4A and 4B are cross-sectional views of the piezoelectric micro speaker illustrated in FIG. 3 taken along lines S1-S2 and S3-S4 of FIG. 3, respectively.
Figure 4B:
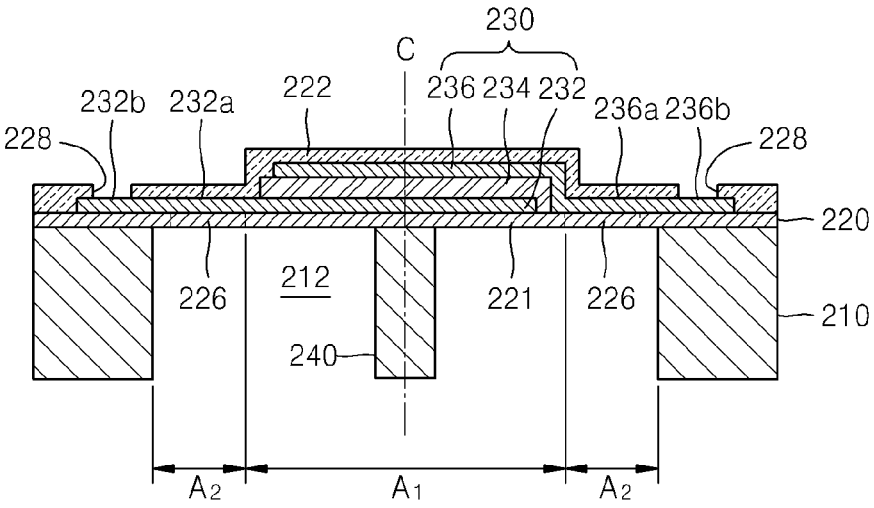

FIG. 3 is a plan view of a piezoelectric micro speaker, according to another embodiment. (A second vibrating membrane 222 of this embodiment is not illustrated in FIG. 3.) FIGS. 4A and 4B are cross-sectional views of the piezoelectric micro speaker illustrated in FIG. 3 taken along lines S1-S2 and S3-S4 of FIG. 3, respectively.

Referring to FIGS. 3, 4A, and 4B, the piezoelectric micro speaker includes a diaphragm 220 formed on a substrate 210 to cover a cavity 212. The diaphragm 220 includes a first vibrating membrane 221 and the second vibrating membrane 222 that are formed in a region corresponding to the cavity 212. The first vibrating membrane 221 and the second vibrating membrane 222 are formed of different materials. A piezoelectric actuator 230 is formed on the first vibrating membrane 221. A weight 240 is attached to the center portion of a lower surface of the first vibrating membrane 221.

More specifically, the diaphragm 220 may be formed having a predetermined thickness on one side of the substrate 210. The first vibrating membrane 221 is formed in a first region A1 of the diaphragm 220 that is disposed on the center portion of the cavity 212. The second vibrating membrane 222 is formed in a second region A2 of the diaphragm 220 that is disposed on the edge of the cavity 212. That is, the second vibrating membrane 222 is formed to surround the first vibrating membrane 221 from the outside of the first vibrating membrane 221. The second vibrating membrane 222 is disposed between the diaphragm 220 that is disposed on the substrate 210 and the first vibrating membrane 221 to connect therebetween, thereby supporting the first vibrating membrane 221 and the piezoelectric actuator 230 formed on the first vibrating membrane 221 with respect to the substrate 210. The second vibrating membrane 222 may also be formed on the second region A2, on the upper surface of the piezoelectric actuator 230 in the first region A1 (inside the second region A2), and on the upper surface of the diaphragm 220 outside the second region A2. In this case, an aperture 228 may be formed in the second vibrating membrane 222 in order to externally expose a first electrode pad 232*b* and a second electrode pad 236*b* that will be described later.

The first vibrating membrane 221 and the second vibrating membrane 222 may be formed of different materials. The second vibrating membrane 222 may be formed of a soft material having a low modulus of elasticity so that the second vibrating membrane 222 may be more easily deformable than the first vibrating membrane 221. The first vibrating membrane 221 may be formed of a material having a modulus of elasticity of between about 50 GPa and about 500 GPa, for example, a silicon nitride. The second vibrating membrane 222 may be formed of a material having a modulus of elasticity of between about 1000 MPa and about 5 GPa, for example, a polymer thin film.

The piezoelectric actuator 230 may include a first electrode layer 232, a piezoelectric layer 234, and a second electrode layer 236 that are sequentially formed on the first vibrating membrane 221. The first electrode layer 232 and the second electrode layer 236 may be formed of conductive metals. The piezoelectric layer 234 may be formed of a piezoelectric material, for example, AlN, ZnO, or LZT.

A first lead line 232*a* that is connected to the first electrode layer 232 of the piezoelectric actuator 230 and a second lead line 236*a* that is connected to the second electrode layer 236 of the piezoelectric actuator 230 may be formed on the diaphragm 220. The first lead line 232*a* and the second lead line 236*a* may be on opposite sides of a center of the piezoelectric actuator 230. A first electrode pad 232*b* is connected to an end of the first lead line 232*a*. A second electrode pad 236*b* is connected to an end of the second lead line 236*a*. A supporter 226 that supports the first lead line 232*a* and the second lead line 236*a* may be formed in the second region A2. The supporter 226 may be formed of the same material as the first vibrating membrane 221, and may be formed to connect the first vibrating membrane 221 and the diaphragm 220 disposed on the substrate 210 across the second region A2. As described above, the second vibrating membrane 222 connects the diaphragm 220 disposed on the substrate 210 and the first vibrating membrane 221, whereas the supporter 226 connects the diaphragm 220 disposed on the substrate 210 and the first vibrating membrane 221 in regions corresponding to the areas where the first lead line 232*a* and the second lead line 236*a* are formed.

The weight 240 is disposed in the cavity 212 and is attached to the center portion of the lower surface of the first vibrating membrane 221. The weight 240 is the same as described with reference to FIGS. 1 and 2B and thus the detailed description thereof will not be repeated here.

As described above, since the weight 240 is attached to the center portion of the lower surface of the first vibrating membrane 221 in the present embodiment with reference to FIGS. 3 and 4A and 4B, the effect can be obtained as described with reference to FIGS. 1 and 2A and 2B. Also, the second vibrating membrane 222 that is formed of a soft material having a relatively low modulus of elasticity is disposed in the second region A2 of the diaphragm 220 that is disposed in the edge of the cavity 212, which reduces a structural rigidity of the diaphragm 220 and increases the deformability thereof, thereby improving the sound output.

Figure 5A:
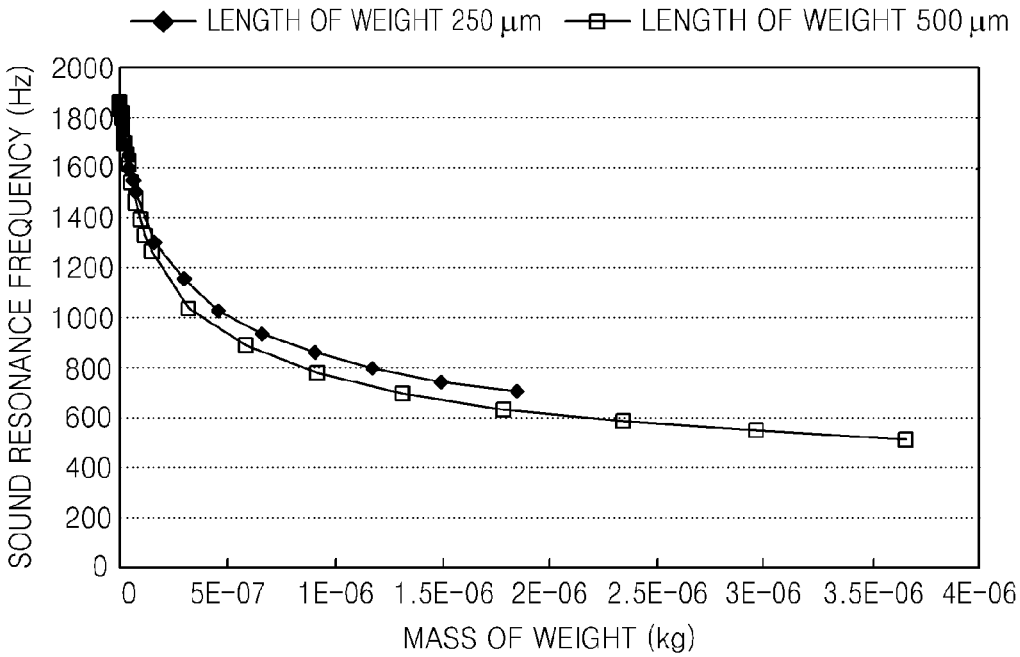
FIG. 5A is a graph illustrating a result of simulating variations of a resonance frequency with respect to an increase in the mass of weight of the piezoelectric micro speaker of FIG. 3 according to an embodiment.
Figure 5B:
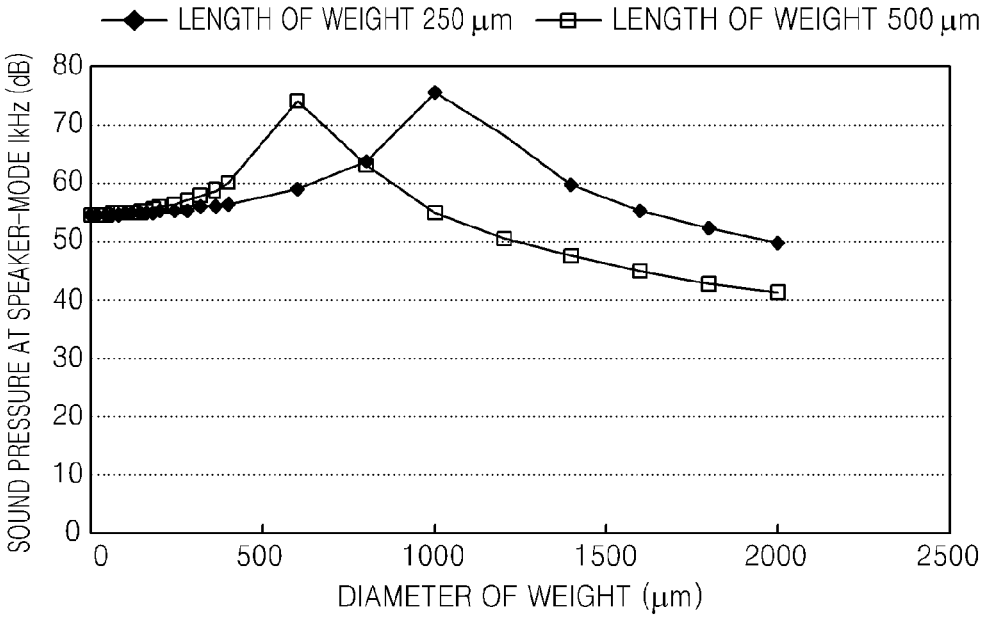
FIG. 5B is a graph illustrating a result of simulating variations of a sound pressure at a frequency of 1 KHz with respect to a diameter in the weight of the piezoelectric micro speaker of FIG. 3 according to another embodiment.

FIG. 5A is a graph illustrating a result of simulating variations of a resonance frequency with respect to an increase in the mass of weight of the piezoelectric micro speaker of FIG. 3 according to an embodiment. FIG. 5B is a graph illustrating a result of simulating variations of a sound pressure at a frequency of 1 KHz with respect to a diameter in the weight of the piezoelectric micro speaker of FIG. 3 according to another embodiment of the present invention.

Referring to FIG. 5A, an increase in the mass of the weight results in a reduction in the resonance frequency. Likewise, the reduction in the resonance frequency results in an increase in the sound pressure at a frequency band lower than the resonance frequency. Referring to FIG. 5B, when the resonance frequency is higher than 1 KHz, if the diameter of the weight is greater than about 1000 μm, an increase in the diameter of the weight results in the reduction in the sound pressure at the frequency of 1 KHz. However, if the diameter of the weight is smaller than about 1000 μm, the sound pressure is high at the frequency of 1 KHz compared to the case where there is no weight. If the diameter of the weight is very small, for example, if the diameter of the weight is smaller than 50 μm, since the mass of the weight is very small, a reduction in the resonance frequency may be expected. Therefore, the diameter of the weight may be appropriately between about 50 μm and about 1000 μm based on the simulation results shown in FIGS. 5A and 5B.

A method of sequentially manufacturing the piezoelectric micro speaker having the above-described structure will now be described.

Figure 6A:
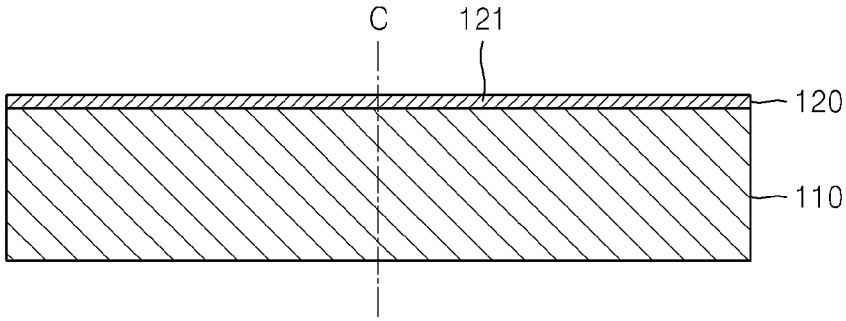
FIGS. 6A through 6C are cross-sectional views for describing a method of manufacturing the piezoelectric micro speaker illustrated in FIG. 1, according to an embodiment.
Figure 6B:
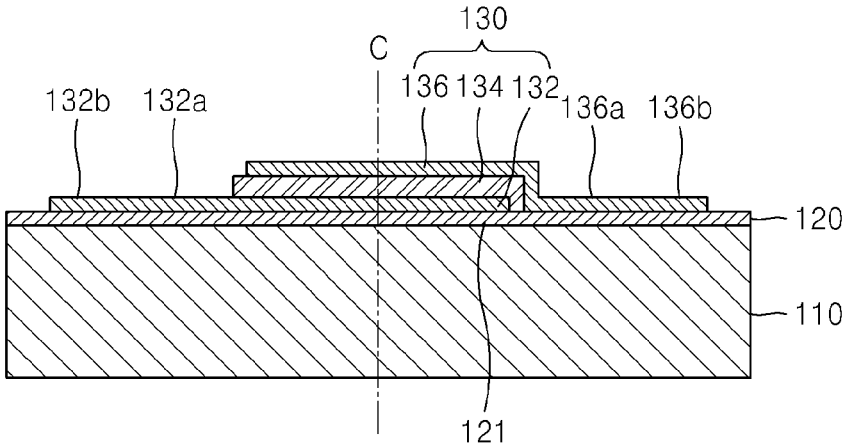
Figure 6C:
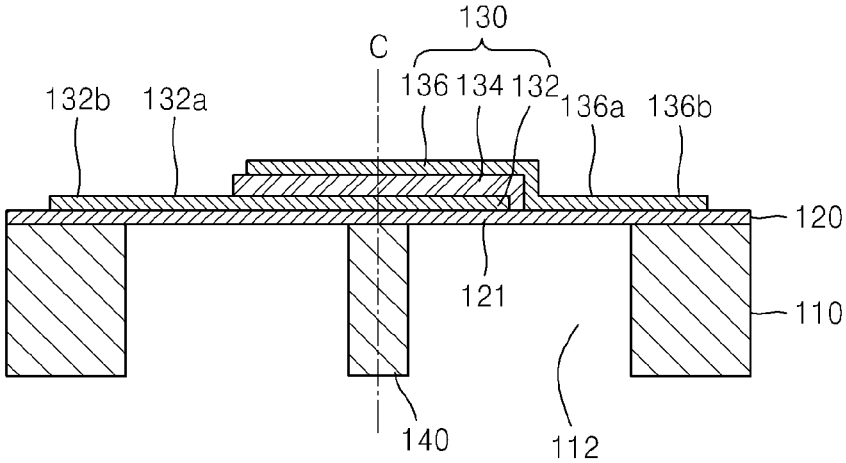

FIGS. 6A through 6C are cross-sectional views for describing a method of manufacturing the piezoelectric micro speaker illustrated in FIG. 1, according to an embodiment. The cross-sectional views are taken along lines S3-S4 of FIG. 1.

Referring to FIG. 6A, the substrate 110 is prepared. The substrate 110 may be formed of a silicon wafer that is able to be finely micromachined. The diaphragm 120 is formed on a surface of the substrate 110 having a predetermined thickness. More specifically, the diaphragm 120 may be formed by depositing an insulating material such as silicon nitride SixNy, for example, $Si_3N_4$ on the surface of the first substrate 110 to a thickness between about 0.5 μm and about 3 μm by using a chemical vapor deposition (CVD) process. A part of the diaphragm 120, which covers the cavity 112 that is to be formed during an operation described with reference to FIG. 6C, functions as the vibrating membrane 121.

Referring to FIG. 6B, the piezoelectric actuator 130 is formed on the vibrating membrane 121 of the diaphragm 120. The piezoelectric actuator 130 may be formed by sequentially stacking the first electrode layer 132, the piezoelectric layer 134, and the second electrode layer 136 on a surface of the vibrating membrane 121. More specifically, the first electrode layer 132 may be formed by depositing a conductive metallic material such as Cr, Au, Mo, Cu, Al, Ti, or Pt, etc. on the vibrating membrane 121 to a thickness between about 0.1 μm and about 3 μm via evaporation or sputtering, and then, patterning the conductive metallic material to have a predetermined shape. In this regard, the first electrode layer 132 may be a single layer metal film or a multi-layer metal film. Simultaneously with the forming of the first electrode layer 132, the first lead line 132*a* connected to the first electrode layer 132 and the first electrode pad 132*b* connected to an end of the first lead line 132*a* may be formed on the diaphragm 120. The piezoelectric layer 134, which is formed of a piezoelectric material, for example, AlN, ZnO, PZT, PbTi03 or PLT may be formed on the first electrode layer 132 to a thickness between about 0.1 μm and about 3 μm via sputtering or spinning. The piezoelectric layer 134 may be thicker than the first electrode layer 132 to cover the first electrode layer 132 in order to insulate the first electrode layer 132 and the second electrode layer 136 that will be described later. The second electrode layer 136 may be formed on the piezoelectric layer 134 in the same manner as in the method of forming the first electrode layer 132. In this regard, simultaneously with the forming of the second electrode layer 136, the second lead line 136*a* connected to the second electrode layer 136 and the second electrode pad 136*b* connected to an end of the second lead line 136*a* may be formed on the diaphragm 120. The second lead line 136*a* may be disposed to be opposite to the first lead line 132*a* in view of the center of the piezoelectric actuator 130.

Referring to FIG. 6C, the cavity 112 is formed to pass through the substrate 110 in a thickness direction by etching a surface of another side of the substrate 110 until the vibrating membrane 121 is exposed. In this regard, an etching mask is used so that a portion corresponding to the center of the cavity 112 is etched. In this way, the weight 140 that is in a columnar shape and is attached to the center portion of a lower surface of the vibrating membrane 121 remains in the cavity 112. The weight 140 may be formed of the same material as the substrate 110, and have the same thickness and length, for example, about 500 μm, as the substrate 110. The weight 140 may have a cylindrical shape and the center thereof may be disposed on the center line C of the cavity 112.

Figure 7A:
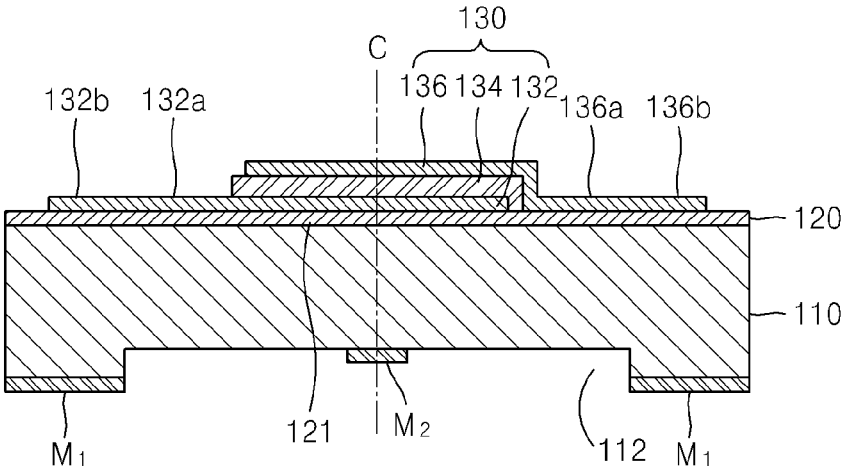
FIGS. 7A and 7B are cross-sectional views for describing a method of forming a weight illustrated in FIG. 6C having a length smaller than a thickness of a substrate, according to an embodiment.
Figure 7B:
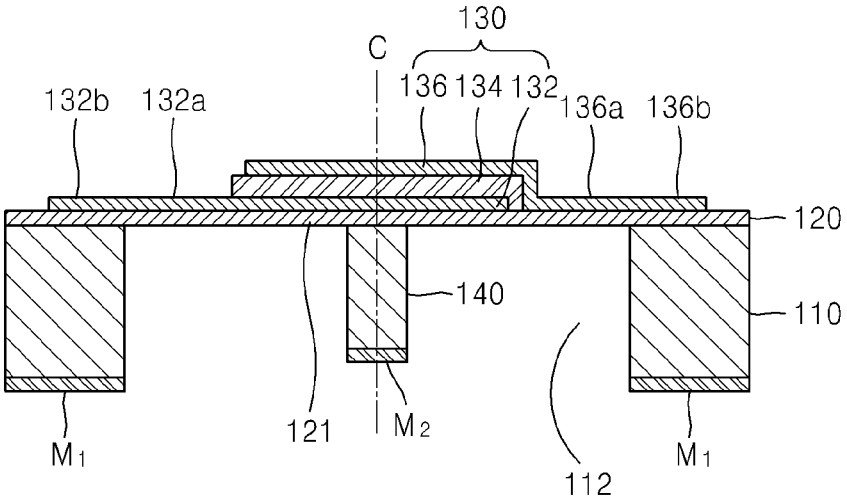

The weight 140 may be formed to have a length smaller than the thickness of the substrate 110. FIGS. 7A and 7B are cross-sectional views for describing a method of forming the weight 140 illustrated in FIG. 6C having a length smaller than the thickness of the substrate 110, according to another embodiment.

Referring to FIG. 7A, a first etching mask M1 is formed on the lower surface of the substrate 110 except a portion of the substrate 110 in which the cavity 112 is to be formed, and the cavity 112 is formed having a predetermined depth by etching the substrate 110.

Thereafter, a second etching mask M2 is formed on the lower surface of the cavity 112 in which the weight 140 is to be formed, and the substrate 110 is again etched until the vibrating membrane 121 is exposed. In this way, the weight 140 having a length smaller than the thickness of the substrate 110, for example, a length of about 250 μm, may be formed in the cavity 112.

FIGS. 8A through 8E are cross-sectional views for describing a method of manufacturing the piezoelectric micro speaker illustrated in FIG. 3, according to another embodiment. The cross-sectional views are taken along lines S1-S4 of FIG. 3.

Figure 8A:
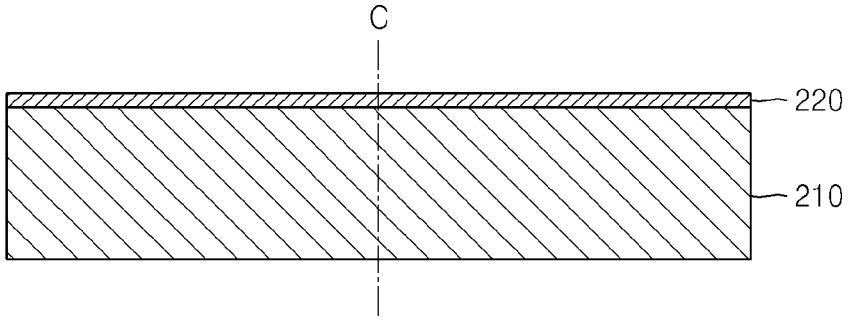
FIGS. 8A through 8E are cross-sectional views for describing a method of manufacturing the piezoelectric micro speaker illustrated in FIG. 3, according to an embodiment.

Referring to FIG. 8A, a silicon wafer that is able to be finely micromachined is prepared as the substrate 210. The diaphragm 220 is formed on a surface of the substrate 110 having a predetermined thickness. A method of forming the diaphragm 220 is the same as the method of forming the diaphragm 120 described with reference to FIG. 6A.

Figure 8B:
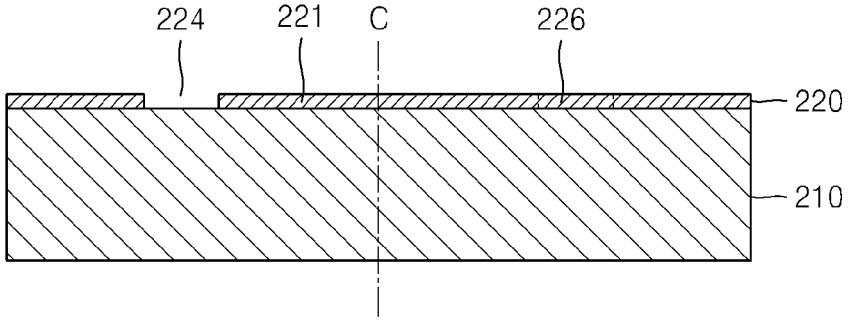

Referring to FIG. 8B, a trench 224 is formed in the second region A2 disposed in the edge of the cavity 212 that will be formed during an operation described with reference to FIG. 8E by etching the diaphragm 220. Then, the first vibrating membrane 221 that is surrounded by the trench 224 is defined in the first region A1 disposed in the center of the cavity 212. In this regard, the trench 224 is not formed in a portion of the second region A2 in which the first lead line 232*a* and the second lead line 236*a* are to be formed during an operation described with reference to FIG. 8C, whereas the supporter 226 that supports the first lead line 232*a* and the second lead line 236*a* may remain therein.

Figure 8C:
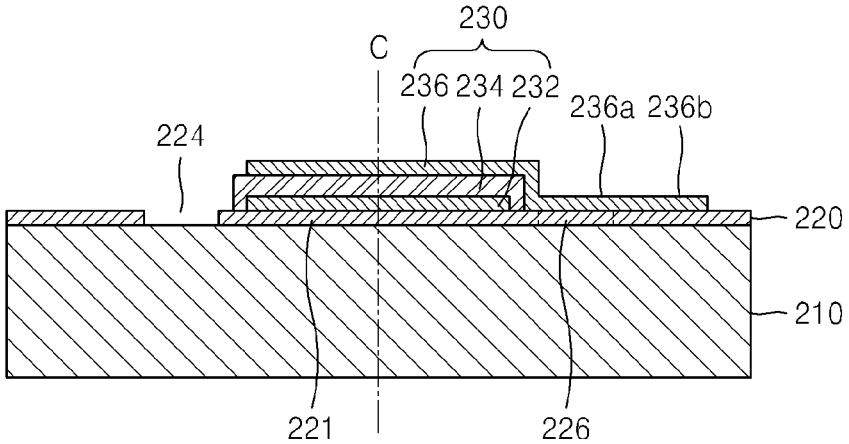

Referring to FIG. 8C, the piezoelectric actuator 230 is formed on the first vibrating membrane 221. The piezoelectric actuator 230 may be formed by sequentially stacking the first electrode layer 232, the piezoelectric layer 234, and the second electrode layer 236 on the first vibrating membrane 221.

A method of forming the piezoelectric actuator 230 is the same as the method of forming the piezoelectric actuator 130 described with reference to FIG. 6B and thus the detailed description thereof will not be repeated here.

Simultaneously with the forming of the first electrode layer 232, the first lead line 232*a* connected to the first electrode layer 232 and the first electrode pad 232*b* connected to an end of the first lead line 232*a* may be formed on the diaphragm 220. Simultaneously with the forming of the second electrode layer 236, the second lead line 236*a* connected to the second electrode layer 236 and the second electrode pad 236*b* connected to an end of the second lead line 236*a* may be formed on the diaphragm 220. The first lead line 232*a* and the second lead line 236*a* may be formed on the surface of the supporter 226 as described above.

Figure 8D:
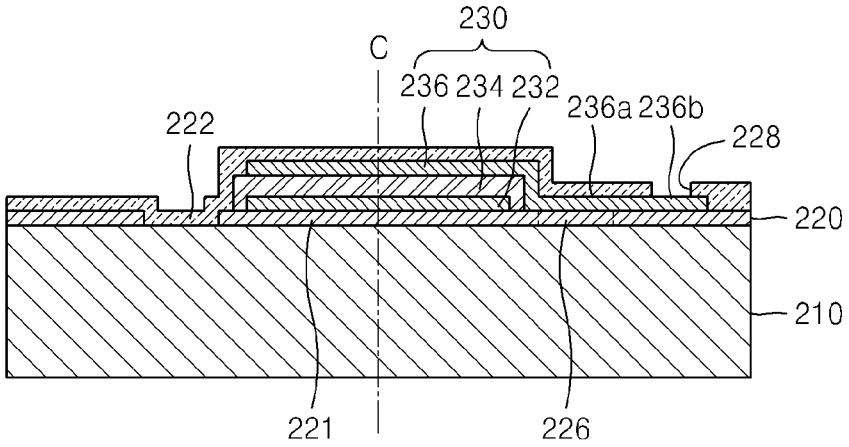

Referring to FIG. 8D, after the piezoelectric actuator 230 is formed, the second vibrating membrane 222 that is formed of a different material from the first vibrating membrane 221 is formed in the trench 224. The second vibrating membrane 222 may be formed of a soft material having a low modulus of elasticity in order to more easily deform the second vibrating membrane 222 than the first vibrating membrane 221. More specifically, the first vibrating membrane 221 may be formed of a silicon nitride as described above, and the second vibrating membrane 222 may be formed of a polymer thin film that is deposited to a thickness between about 0.5 μm and about 10 μm, for example.

The second vibrating membrane 222 may be formed in the second region A2, on the upper surface of the piezoelectric actuator 230 in the first region A1 (inside the second region A2), and on the upper surface of the diaphragm 220 outside the second region A2. In this case, the aperture 228 may be formed in the second vibrating membrane 222 in order to externally expose the first electrode pad 232*b* and the second electrode pad 236*b*.

Figure 8E:
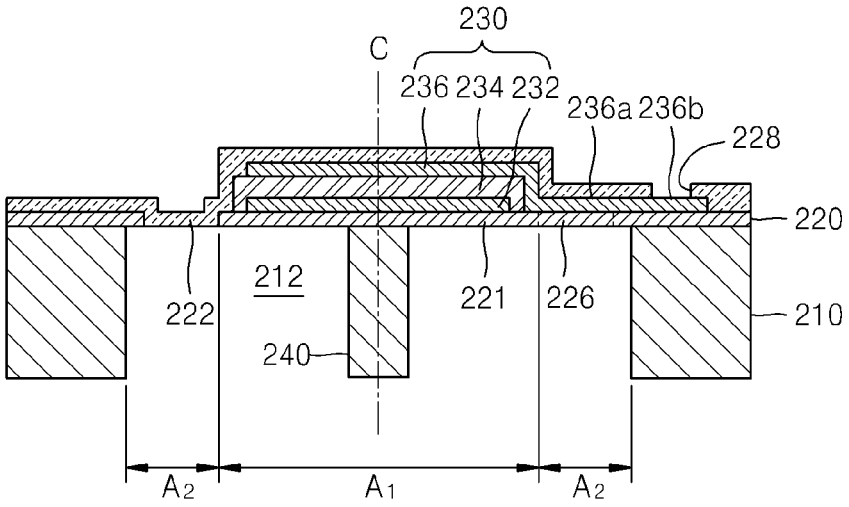

Referring to FIG. 8E, the cavity 212 is formed to pass through the substrate 110 in a thickness direction by etching a surface of another side of the substrate 110 until the first vibrating membrane 221 and the second vibrating membrane 222 are exposed. In this regard, an etching mask may be used so that a portion corresponding to the center of the cavity 212 is not etched. In this way, the weight 140 that is in a columnar shape and is attached to the center portion of a lower surface of the first vibrating membrane 221 remains in the cavity 212.

The weight 240 is the same as the weight 140 described with reference to FIG. 6C and thus the detailed description thereof will not be repeated here. The weight 240 may have a length smaller than a thickness of the substrate 210 as described with reference to FIGS. 7A and 7B.

Thus, the piezoelectric micro speaker having a structure in which the first vibrating membrane 221 is disposed in the first region A1 in the center of the cavity 212, the second vibrating membrane 222 formed of a soft material is disposed in the second region A2 in the edge of the cavity 212, and the weight 240 is attached to the center portion of the lower surface of the first vibrating membrane 221 is completely manufactured.

It should be understood that the embodiments described herein should be considered in a descriptive sense only and not for purposes of limitation. Descriptions of features or aspects within each embodiment should typically be considered as available for other similar features or aspects in other embodiments.

What is claimed is:

1. A piezoelectric micro speaker comprising:

a substrate having a cavity therein;

a diaphragm that is disposed on the substrate, the diaphragm comprising a vibrating membrane that overlaps the cavity;

a piezoelectric actuator that is disposed on the vibrating membrane; and a weight that is disposed in the cavity and attached to a center portion of the vibrating membrane, wherein the vibrating membrane of the diaphragm comprises a first vibrating membrane that is disposed over a center of the cavity, and a second vibrating membrane that is disposed over an edge of the cavity and formed of a different material from the first vibrating membrane, and wherein the piezoelectric actuator is disposed on the first vibrating membrane, and the weight is attached to a center portion of the first vibrating membrane.

2. The piezoelectric micro speaker of claim 1, wherein the weight has a substantially columnar shape, and a center of the weight is disposed on a center line of the cavity.

3. The piezoelectric micro speaker of claim 2, wherein the weight and the substrate are formed of a same material, and a length of the weight is equal to or smaller than a thickness of the substrate.

4. The piezoelectric micro speaker of claim 1, wherein the piezoelectric actuator comprises a first electrode layer disposed on the vibrating membrane, a piezoelectric layer disposed on the first electrode layer, and a second electrode layer disposed on the piezoelectric layer.

5. The piezoelectric micro speaker of claim 4, further comprising:

a first lead line that is connected to the first electrode layer and disposed on the diaphragm;

a second lead line that is connected to the second electrode layer and is disposed on the diaphragm;

a first electrode pad that is connected to an end of the first lead line; and a second electrode pad that is connected to an end of the second lead line.

6. A piezoelectric micro speaker comprising:

a substrate having a cavity therein;

a diaphragm that is disposed on the substrate, the diaphragm comprising a vibrating membrane that overlaps the cavity;

a piezoelectric actuator that is disposed on the vibrating membrane; and a weight that is disposed in the cavity and attached to a center portion of the vibrating membrane, wherein the weight has a substantially columnar shape, and a center of the weight is disposed on a center line of the cavity, and wherein the weight has a substantially cylindrical shape, and a diameter of the weight is between about 50 μm and about 1000 μm.

7. The piezoelectric micro speaker of claim 1, wherein the second vibrating membrane is formed of a material having a lower modulus of elasticity than a material of the first vibrating membrane.

8. The piezoelectric micro speaker of claim 1, wherein the second vibrating membrane comprises a polymer thin film.

9. The piezoelectric micro speaker of claim 1, wherein the second vibrating membrane is additionally disposed on an upper surface of the piezoelectric actuator and an upper surface of the diaphragm outside the cavity.

10. The piezoelectric micro speaker of claim 6, wherein the weight and the substrate are formed of a same material, and a length of the weight is equal to or smaller than a thickness of the substrate.

11. The piezoelectric micro speaker of claim 6, wherein the piezoelectric actuator comprises a first electrode layer disposed on the vibrating membrane, a piezoelectric layer disposed on the first electrode layer, and a second electrode layer disposed on the piezoelectric layer.

12. The piezoelectric micro speaker of claim 11, further comprising:

a first lead line that is connected to the first electrode layer and disposed on the diaphragm;

a second lead line that is connected to the second electrode layer and is disposed on the diaphragm;

a first electrode pad that is connected to an end of the first lead line; and a second electrode pad that is connected to an end of the second lead line.

* * * * *